United States Patent [19]

Bracci et al.

[11] Patent Number: 5,044,628

[45] Date of Patent: Sep. 3, 1991

[54] MACHINE FOR THE THERAPEUTIC TREATMENT OF LUMBAGO AND LUMBAGO/SCIATICA

[75] Inventors: Riccardo Bracci; Guglielmina Catelani, both of Pisa; Massimo Fantozzi, Leghorn; Luigi Grimaldi, Pisa; Pietro Marri, Lido Di Camaiore; Paolo Lippi, Lucca, all of Italy

[73] Assignee: T.E.K. S.r.l., Lucca, Italy

[21] Appl. No.: 457,770

[22] PCT Filed: Jan. 20, 1989

[86] PCT No.: PCT/IT89/00003

§ 371 Date: Nov. 21, 1989

§ 102(e) Date: Nov. 21, 1989

[87] PCT Pub. No.: WO89/06527

PCT Pub. Date: Jul. 27, 1989

[30] Foreign Application Priority Data

Jan. 22, 1988 [IT] Italy ..... 9313 A/88

[51] Int. Cl.[5] ..... A63B 23/08

[52] U.S. Cl. ..... 272/96; 272/117

[58] Field of Search ..... 272/96, 117, 118, 130, 272/134

[56] References Cited

U.S. PATENT DOCUMENTS

| | | | |
|---|---|---|---|
| 2,418,154 | 4/1945 | Bell . | |
| 2,969,060 | 1/1961 | Swanda et al. . | |
| 4,452,447 | 6/1984 | Lepley et al. | 272/130 X |
| 4,483,532 | 11/1984 | Sparks | 272/96 |
| 4,600,188 | 7/1986 | Bangerter et al. | 272/118 X |
| 4,693,470 | 9/1987 | Ogawa . | |
| 4,727,860 | 3/1988 | McIntyre | 272/96 X |
| 4,807,874 | 2/1989 | Little | 272/96 |
| 4,836,536 | 6/1989 | Jones | 272/134 |

FOREIGN PATENT DOCUMENTS 71906 11/1893 Fed. Rep. of Germany .

*Primary Examiner*—Robert Bahr

*Attorney, Agent, or Firm*—Browdy and Neimark

[57] ABSTRACT

A machine for the therapeutic treatment of lumbago and lumbago-sciatica comprising a fixed footplate and a footplate movable angularly as a result of the weight of the patient supported in an upright position with one foot on one footplate and another foot on the other footplate with the footplates arranged one in front of the other so that the patient is supported by them in a substantially ambulatory positions with the movable footplate having two adjacent portions intended to act as a support for the front part of the foot and for the heel, respectively. Both portions of the movable footplate are connected to a balanced counterweight designed to maintain the portions in a plurality of prefixed equilibrium positions and in such a way that an angular displacement of one of the positions results in a corresponding opposite angular displacement of the other portion. The balanced counterweight comprises a variable counterweight sliding in response to movements of the portions of the movable footplate and a variable balancing couple designed to brake the sliding movement of the counterweight and by modifying the counterweight and the balancing couple it is possible to vary the movable footplate resistance to the load.

7 Claims, 3 Drawing Sheets

MACHINE FOR THE THERAPEUTIC TREATMENT OF LUMBAGO AND LUMBAGO/SCIATICA

DESCRIPTION

1. Technical Field

The present invention relates to a machine for the therapeutic treatment of lumbago and lumbago/-sciatica.

2. Background Art

It is known that most instances of lumbago and lumbago/sciatica are generally attributed to an incorrect postural position, characterized by excessive forward tilting of the pelvis. This latter phenomenon, together with the lumbar hyperlordosis resulting therefrom, leads to the painful symptoms typical of these disorders, which are a consequence of the disk degeneration process occurring most frequently in the region of the L5-S1 interspace. The period of time which passes between an incorrect postural position being adopted and the onset of the painful symptoms must be measured in years, if not in tens of years.

The therapeutic procedures which are currently adopted are of a pharmacological, physiotherapeutic and kinesitherapeutic nature. In this respect, mention may be made, in particular, of non-steroidal and steroidal anti-inflammatory drugs, superficial and deep heat sources and massagetherapy. As regards kinesitherapy, various indications aimed at relieving the spine are usually associated with exercises designed to strengthen the muscles used in backward tilting of the pelvis. The highly variable nature of the results obtained using these methods gives one the distinct impression that the root of the problem is not being dealt with.

Moreover, it has been asserted that, from a physiological point of view, forward tilting of the pelvis can be adequately controlled not so much through general strenghtening of the muscles able to ensure backward tilting of the same, but more through the restoration of correct synergic functioning of some muscle groups over particular muscle lengths. In the specific case of lumbago and lumbago/sciatica, the muscle groups involved are essentially the ischiotibial muscles. This view has been proved correct by a long series of clinical experiments conducted by the Applicant and based, from a theoretical point of view, on specific neurological literature on the subject, of which the following is mentioned:

1. FELDMAN, A. G. (1980): Superposition of motor programs; I) Rhythmic forearm movements in man; II) Rapid forearm flexion in man; Neuroscience 5, 81-90 and 91-95;
2. FELDMAN A. G. et al. (1982): Afferent and efferent components of joint position sense; interpretation of kinaesthetic illusion; Biological Cybernetics, 42, 205-214;
3. FELDMAN A. G. et al. (1982): Interaction of afferent and efferent signal underlying joint position sense; empirical and theoretical approaches; Journal of Motor Behavior, 14, 174-193;
4. KUGLER, P. N. et al. (1982): On the control and coordination of naturally developing systems; in J. A.-Scott Kelso and Jane E. Clark (ed.), The development of movement control and coordination, New York, Whiley;
5. FELDMAN, A. G. (1986): More observations on the equilibrium-point hypothesis (λ model) for motor control; Journal of Motor Behaviour, 18, Number 1, 27-54.

In substance, it has been ascertained that suitable stimulation, in the sense defined further below, of specific muscular groups together with a perceptual exercise, in the absence of visual information, involving the physical parameters associated with this stimulation, leads to rapid restoration of the correct functioning of these muscle groups and hence, in the specific case of the ischio-tibial muscles, to improved control of forward tilting of the pelvis. Here and in the remainder of the present description, "stimulation" is understood as meaning a therapeutic manipulation of the mathematical/topological space complex involving the variables of: muscle length, muscular tension, rate of change in the muscle length.

Such a method has already been used with success by the Applicant in the rehabilitation of paralysed patients and in particular in the rehabilitation of one limb of hemiplegic patients, so as to restore the motor functions affected by lesions of the central nervous system, both of a vascular and traumatic nature. A machine has been developed for this purpose, by means of which the patient undergoes a therapeutic exercise consisting in the stimulation of certain muscle groups and the patient being asked to perform a perceptual activity aimed at assessing, for example, the degree of passive movement to which the limb is subjected or providing a comparison with the stimulation(s) previously induced. The Applicant has found that the patients subjected to treatment of the aforementioned type, i.e. consisting in stimulations and associated perceptual exercises conducted as explained above, rapidly reacquire the ability to produce voluntarily those movements initially induced artificially by means of the said stimulations.

The machine used to produce stimulations aimed at rehabilitating paralysed patients substantially comprises, in combination, first means, consisting in particular of a movable platform, for guiding a paralysed limb of the patient, such as a lower limb, along a predetermined trajectory and according to a pattern of movement which is also predetermined, such that at least one muscle of the paralysed organ is simultaneously subjected to kinematic contraction and to a tensile force, and comprises second means designed to modify in an adjustable manner the trajectory and/or the pattern of movement of the limb guided by the first means, so as to create in the patient a perceptual stimulus affecting almost exclusively the paralysed limb. In this way it is possible to achieve all those conditions (muscles subjected to kinematic contraction and at the same time to tensile force, and generation of nerve impulses directed towards those muscles) which, according to the research and studies carried out be the Applicant, are the necessary conditions for the paralysed limb to be rehabilitated.

This machine, however, has not proved to be effective in the therapeutic treatment of lumbago and lumbago/sciatica since it does not ensure that those muscle groups, namely the ischio-tibial muscles, which are involved in this type of disorder, are stressed. In particular, initial assessment of the patient's condition—an aspect which is of fundamental importance when prescribing treatment—, raises problems. In fact, using the abovedescribed machine it is not possible to direct selectively the predetermined stimulation on the heel so as to produce a counter-reaction which subjects the ischio-tibial muscle group to a tensile force.

DISCLOSURE OF THE INVENTION

The object of the present invention is to provide a machine which, based on the clinical methodology described above and already experimented with in the rehabilitation of paralysed patients, allows therapeutic treatment of lumbago and lumbago/sciatica.

According to the fundamental characteristic feature of the present invention, the movable footplate consists of two adjacent portions, called the front portion and rear portion, on which the patient rests a foot so that the heel is on the rear portion of the footplate and the front part of the foot is on the front portion. Moreover, provision is made for balanced counterweight means for balancing the movable footplate to which the two portions thereof are connected via intrinsic drive means designed to transmit torques in the opposite direction to the said balanced counterweight means, whereby angular displacement of a portion of the said footplate in one direction results in displacement of the other portion, by the same amount, in the opposite direction. The said balanced counterweight means are therefore designed to determine a plurality of equilibrium position for the said front portion and rear portion of the movable footplate, which positions are characterized by a varying resistence to the load applied by the patient. The said means comprise in particular a variable counterweight, which is able to slide in accordance with the movements of the said movable footplate, and a balancing couple, also variable, designed to brake the sliding movement of the counterweight.

Preferably, the said balanced counterweight means comprise, in addition, an axis of rotation connected to the two portions of the said movable footplate via the said drive means and subjected to opposing torques applied by the counterweight and the said footplate, the said balancing couple consisting of two arms which are integral with the said axis and are separated angularly and which carry two sliding weights positioned along them.

BRIEF DESCRIPTION OF THE DRAWINGS

Further characteristic feature and advantages of the machine according to the present invention will emerge more clearly from the following description of an embodiment thereof, given by way of a nonlimiting example with reference to the accompanying drawings in which.

BEST MODE FOR CARRYING OUT THE INVENTION

Figure 4:
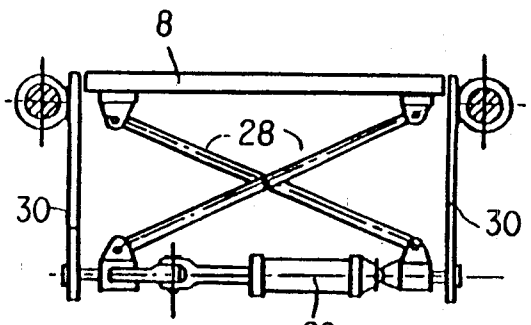
FIG. 4 is a sectional view in the direction of the arrows IV—IV shown in FIG. 2.
Figure 1:
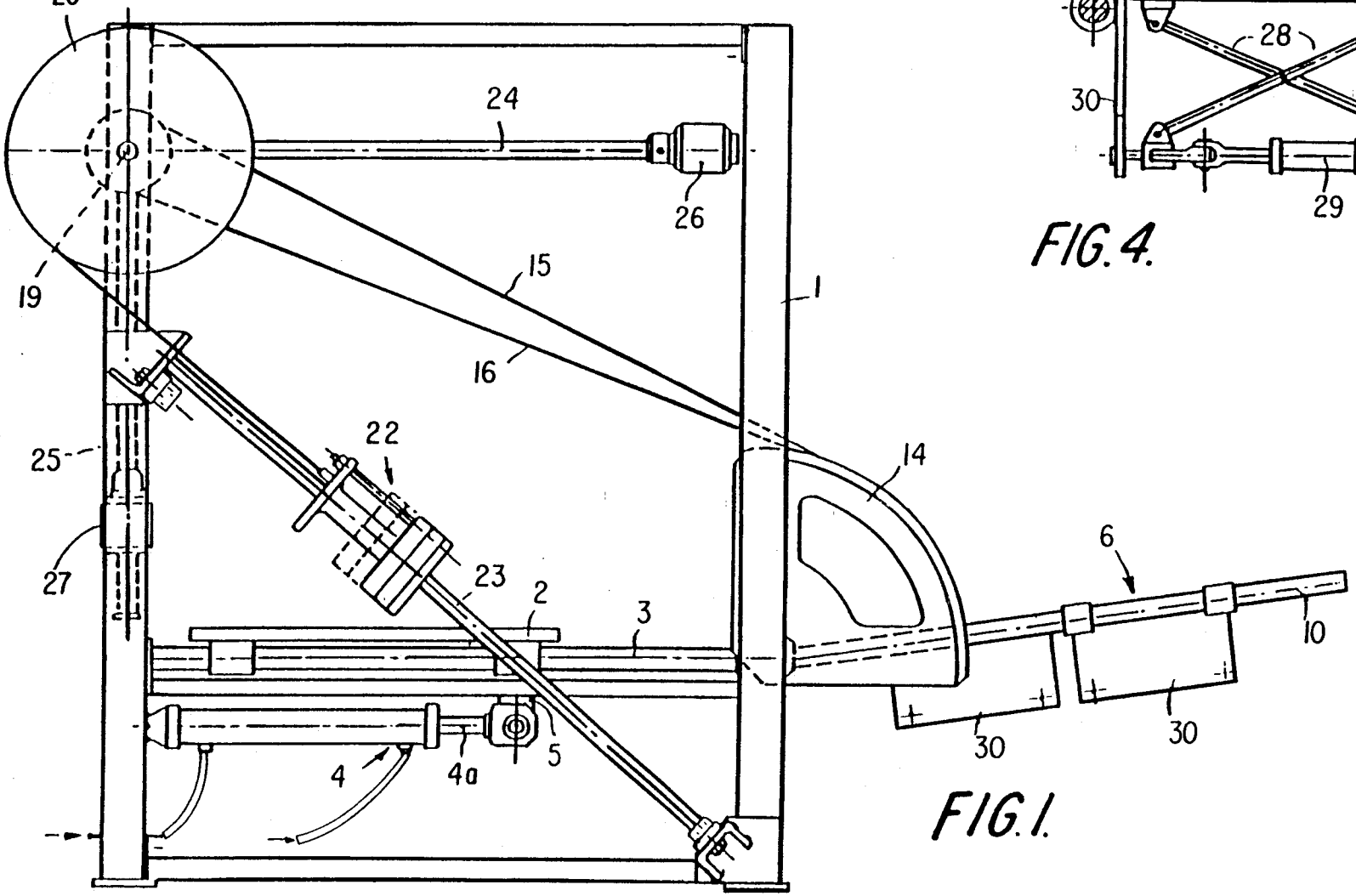
FIG. 1 is a side elevation view of the machine according to the invention.
Figure 2:
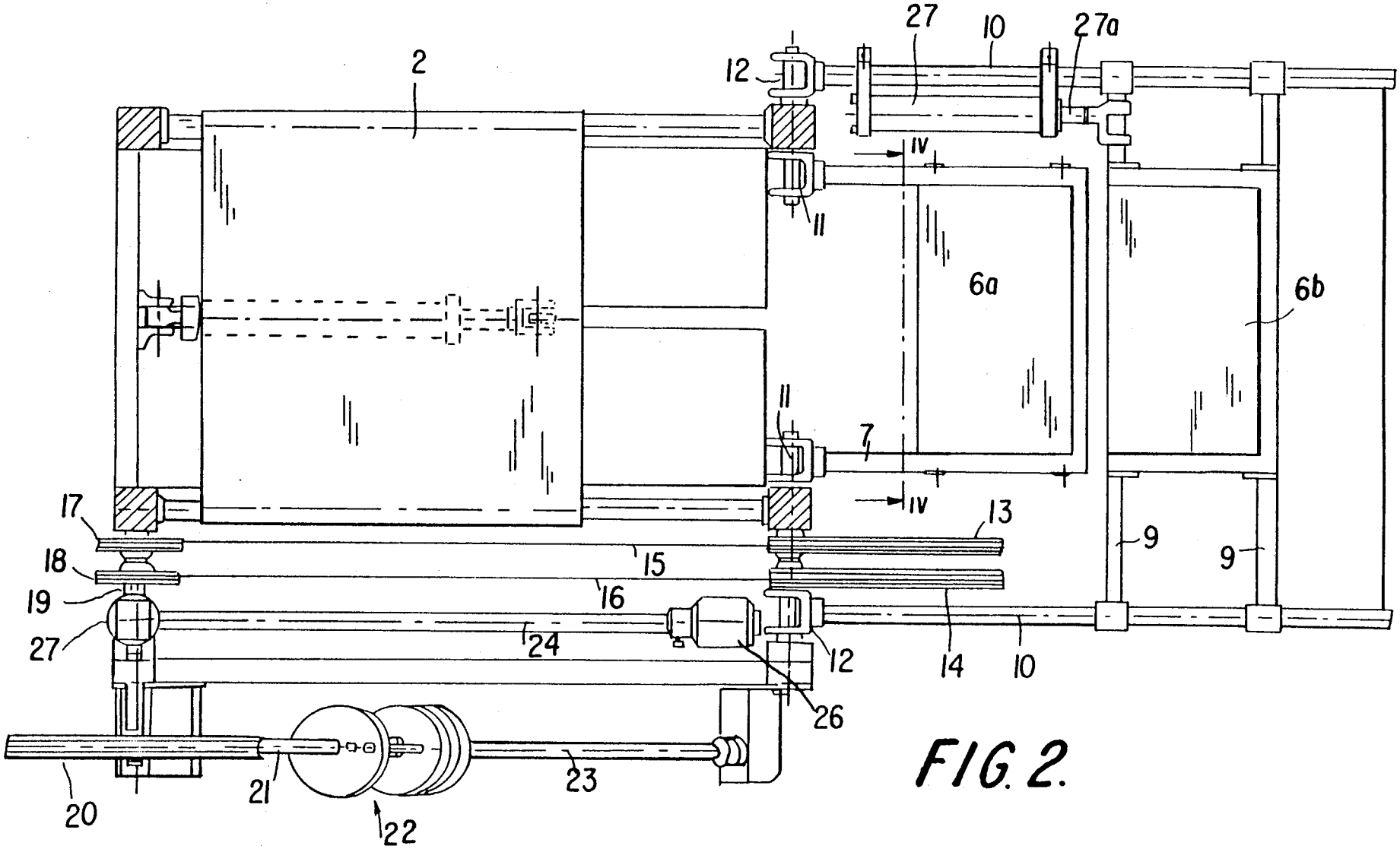
FIG. 2 is a plan view from the top of the machine shown in FIG. 1.
Figure 3:
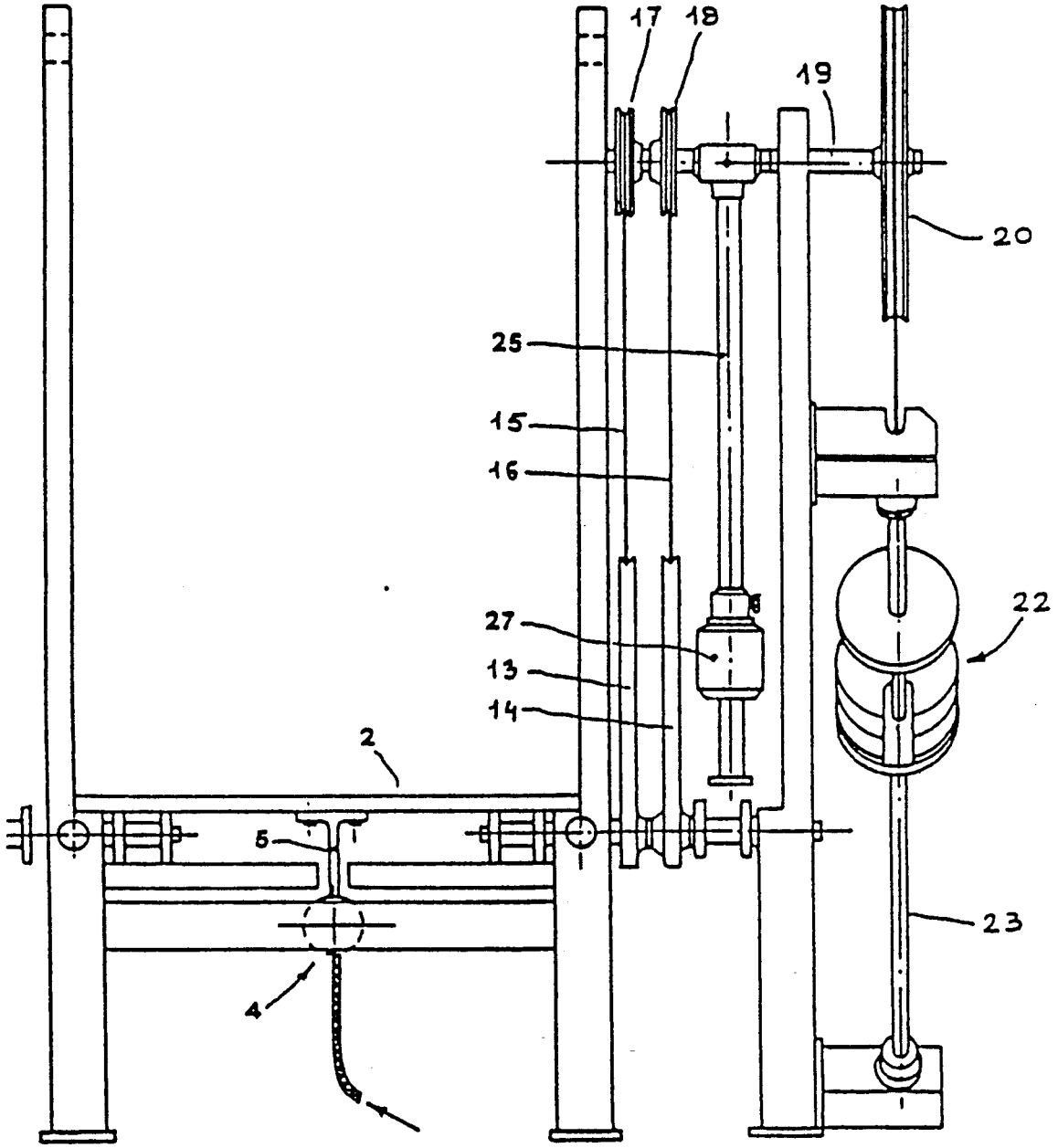
FIG. 3 is a rear side elevation view of the machine according to the invention.

With reference to the abovementioned figures, 1 denotes a support frame of the machine consisting of uprights and crosspieces and 2 denotes a fixed footplate which is supported by two horizontal bars 3 integral with the frame 1 and which can be positioned, depending on the requirements, along the said bars by means of an actuator 4 which is hydraulic or pneumatic or the like and the piston rod **4*a* of which is rigidly connected, via the bracket 5, to the footplate itself. A movable footplate 6, consisting of a rear portion 6*a* and a front portion 6*b*, is provided so as to be aligned at the front with the fixed footplate 2 and is operatively arranged in an inclined position with respect to the horizontal. The rear portion 6*a* is fixed to a pair of arms 7 rotatably connected in cantilever fashion to the frame 1 of the machine, while the second portion 6*b* at the front is similarly fixed via a pair of crosspieces 9 to a pair of arms 10 which are parallel to the arms 7 and outside the latter and which are rotatably connected in cantilever fashion to the frame 1** of the machine.

In particular, the two pairs of arms 7 and 10 are connected to the frame 1 of the machine by means of two respective pairs of pins 11 and 12 with which the said arms are integral and which are rotatably supported by the adjacent uprights of the frame 1. On two of the pins 11 and 12 there are also integrally mounted two segment pulleys 13 and 14 connected via respective belts 15 and 16 to two corresponding pulleys 17 and 18 keyed onto a shaft 19 rotatably supported by the top part of the frame 1. The two belts 15 and 16 are wound in opposite directions on the respective pulleys 17 and 18 so that rotation of the segment 13 in one direction results in rotation of the segment 14 in the opposite direction. In other words, to summarise, a downward displacement of the rear portion **6*a* results in an upward displacement of the front portion 6*b* by the same amount. An additional pulley 20 is keyed onto the shaft 19 and fixed thereto is one end of a tie-rod 21 which has fixed to its other end a variable counterweight 22 constrained so as to slide along a guide 23 extending diagonally along one side of the frame 1 and fixed to it via its ends. The tie-rod 21 is connected to the pulley 20 so that the torque exerted on the shaft 19 via the said tie-rod varies from that exerted on the same by the rear portion 6*a* via the segment 13, the pulley 17 and the connection belt 15. Two arms 24 and 25, which are coplanar and angularly separated from each other, extend radially from the shaft 19 on which they are rigidly mounted. The plane in which the two arms 24 and 25 lie is vertical and in particular the latter are separated by 90° from each other. The two arms 24 and 25 have mounted on them weights 26 and 27** which slide and can be positioned at any point along them.

The distance of the front portion **6*b* of the movable footplate 6 from the front portion 6*a* can be adjusted according to requirements, since the crosspieces 9 which support them are slidably mounted on the arms 10 and are connected, in addition, to the piston rod 27*a* of an actuator 27 which is hydraulic, pneumatic or the like and which can be operated so as to move the front portion 6*b*** forwards or backwards.

It is also possible to set the machine according to the invention for further adjustement of the position of the two portions **6*a* and 6*b* with respect to the plane in which the fixed footplate 2 lies. For this purpose, as shown in particular in FIG. 4 for the rear portion 6*a*, the latter is not directly supported by the crosspieces 9, but instead by at least two pairs of rods 28 which intersect and are hinged at their middle point and connected to the ends of an actuator 29 which is hydraulic or pneumatic or the like and which is in turn supported by two plates 30 extending from the crosspieces 9. It is obvious that operation of the actuator 29 results in a variation of the angle of intersection between the rods 28 and in a corresponding raising or lowering movement of the footplate portion 6a. A similar vertical positioning device is provided for the front portion 6b, so that the two footplates can be raised or lowered with respect to the fixed footplate 2**.

If one foot is placed on the two portions 6a and 6b of the movable footplate, assumed to be coplanar, and the other one is placed on the fixed footplate 2 and the body weight applied onto the movable footplate 6, assuming that there is equal distribution of load on the two portions, the counterweight 22 will not move since the belts 15 and 16 transmit to the shaft 19 tensile forces which are of the same intensity and in the same direction and which hence have varying torques. If the load is not distributed symmetrically on the two portions, sliding of the counterweight 22 will occur and there will be corresponding integral rotation of the pair of arms 24 and 25 in the clockwise or anti-clockwise direction depending on whether the load is applied on the rear portion 6b, i.e. on the heel, or on the front portion, i.e. on the front part of the foot. It is moreover obvious that, since lowering of the rear portion 6a causes raising of the front portion 6b and vice versa, a small relative movement is sufficient to restore the balance of the system since, with the foot being a continuos object albeit flexible to a certain degree, lowering for example the front portion 6a causes the rear portion 6b to press immediately against the front part of the foot.

When using the machine according to the invention, the patient stands on it with one foot on the fixed footplate 2 and the other on the movable footplate 6, thereby resulting in a substantially ambulatory posture. The basic therapeutic movement which the patient is required to perform consists in moving the body weight from the leg located at the rear, i.e. resting on the fixed footplate 2, to the leg positioned at the front, i.e. resting on the movable footplate 6. In order to assess the initial condition of the patient, it is necessary to check first of all whether he or she, for varying lengths of stride, applies his or her own body weight onto the front part of the foot or onto the heel. This differentiation corresponds to the static structural posture of the patient and the shaft 19 tends to rotate in one direction or the other depending on whether the load is distributed on the heel or on the front part of the foot. Initially, the therapist must also balance the patient's load by adjusting the weight 27 and then moving the weight 26 according to the prechosen counterweight 22. Clearly the resistance offered by the movable plate 6 is proportional to the value of the counterweight 22.

Before each basic therapeutic movement is performed, the therapist adjusts the weights 22, 26 and 27 so as to vary in each case the resistance which the rear portion 6a of the movable footplate 6 offers the patient when the latter performs the said movement. The front portion 6b of the movable footplate 6 is generally arranged at a lower level than the rear portion 6a so as to act as a brake in relation to contact with the front part of the foot. While the patient performs the basic therapeutic movement, which as a result of the yielding action of the movable footplate 6 causes stimulation of the ischiotibial muscle groups, he or she is also required to perform a perceptual activity, in the absence of visual or auditory information, relating to the degree of resistance encountered when performing this movement, compared to the resistance encountered during the previous movement. In other words, when performing the basic therapeutic movement, the patient is required to say whether the movable footplate offers greater or less resistance than during the previous movement. Since the patient has no access to any source of sensory information, he or she is forced to make the assessments in each case required of him or her, solely on the basis of nerve control impulses corresponding to the variation in length and tension of the muscle groups involved during execution of the movement.

The essential criterion for assessing the results in an objective manner during treatment is the modification of the load in the direction of the heel, detectable through comparison with the initial assessment. This assessment could also be achieved through the possible use of load sensors positioned on the rear portion 6a and on the front portion 6b of the movable footplate 6.

From the clinical survey described it was shown that on average after three days of therapeutic treatment consisting in about twenty minutes, per day, of perceptual exercises performed as explained above, the correct postural position of the pelvis is restored, with lumbar hyperlordosis being eliminated and the patient more or less fully recovered. On average the painful symptoms disappeared right from the first day of treatment.

Variations and/or modifications may be made to the apparatus for therapeutic treatment of lumbago and lumbago/sciatica according to the present invention, without thereby going outside the protective scope of the invention itself.

We claim:

1. A machine for the therapeutic treatment of lumbago and lumbago-sciatica diseases comprising a fixed footplate;

a movable footplate movable by the weight of a patient supported angularly in an upright position with one foot of the patient on one of said footplates and another foot of the patient on the other of said footplates;

said footplates being arranged one in front of the other so that the patient is supported by them in a substantially ambulatory position;

said movable footplate including two adjacent portions, a front portion and a rear portion, for supporting the front part of the foot of the patient and the heel of the patient respectively;

a balanced counterweight means connecting to said front portion and said rear portion and locatable to a plurality of equilibrium positions for said portions by varying resistance to a load applied by the patient when displacing the patient's own body weight from said fixed footplate to said movable footplate;

said balanced counterweight means including a variable counterweight sliding in response to movements of said movable footplate, a balancing couple means for braking the sliding movement of said variable counterweight, and a common axis of rotation connected to said movable footplate and said counterweight means;

separate drive means for each of said portions of said movable footplate connecting them to said counterweight means through said common axis of rotation in order to impart to said counterweight means a rotational movement corresponding to the relative angular displacement of said portions;

each of said portions of said movable footplate connected to transmit torques acting in opposite directions to said counterweight means;

a frame supporting said fixed footplate and with said front and rear portions of said movable footplate rotatably connected in a cantilevered manner to said frame.

2. The machine in accordance with claim 1 wherein said balancing couple comprises two arms which are separated angularly and are integral with said axis of rotation, sliding weights carried by said arms and positioned along said arms and determining in conjunction with said variable counterweight said plurality of equilibrium positions for said front and rear portions of said movable footplate.

3. The machine in accordance with claim 1 wherein said drive means comprise belts wound in opposite directions, two segment pulleys integral with said rear and front portions respectively, and two pulleys integral with said axis of rotation and connected to said segment pulleys by said belts.

4. The machine in accordance with claim 1 wherein said variable counterweight is movable along a sliding guide.

5. The machine in accordance with claim 1 wherein a distance of said fixed footplate from said movable footplate is adjustable.

6. The machine in accordance with claim 1 wherein a relative height of said front portion and said rear portion of said movable footplate with respect to said fixed footplate is adjustable.

7. The machine in accordance with claim 1 wherein said movable footplate is operatively inclined with respect to the horizontal.

* * * * *